US009586080B2

(12) United States Patent
Pederson et al.

(10) Patent No.: US 9,586,080 B2
(45) Date of Patent: Mar. 7, 2017

(54) WEIGHTED BARBELL STAND

(71) Applicants: Don Pederson, Fontana, CA (US); Marlena C. Santiago, Palm Desert, CA (US)

(72) Inventors: Don Pederson, Fontana, CA (US); Marlena C. Santiago, Palm Desert, CA (US)

( * ) Notice: Subject to any disclaimer, the term of this patent is extended or adjusted under 35 U.S.C. 154(b) by 0 days.

(21) Appl. No.: 14/717,435

(22) Filed: May 20, 2015

(65) Prior Publication Data

US 2015/0335939 A1 Nov. 26, 2015

Related U.S. Application Data

(60) Provisional application No. 62/000,867, filed on May 20, 2014.

(51) Int. Cl.
*A63B 21/078* (2006.01)
*A63B 71/00* (2006.01)
*A63B 21/072* (2006.01)

(52) U.S. Cl.
CPC ..... *A63B 21/078* (2013.01); *A63B 21/0724* (2013.01); *A63B 71/0036* (2013.01)

(58) Field of Classification Search
CPC ... A63B 60/56; A63B 21/072; A63B 21/0722; A63B 21/0724; A63B 21/0726; A63B 21/0728; A63B 21/075; A63B 21/078; A63B 71/0036; A01K 97/00; A01K 97/04; A01K 97/06; A01K 97/08; A01K 97/22; B25H 3/04
USPC ..... 211/41.1
See application file for complete search history.

(56) References Cited

U.S. PATENT DOCUMENTS 4,306,715 A 12/1981 Sutherland
4,579,233 A * 4/1986 Hepp ..... A47B 47/06 211/126.12
4,615,524 A 10/1986 Sutherland
4,880,229 A * 11/1989 Broussard ..... A63B 21/0724 482/106
5,050,868 A * 9/1991 Pearson ..... A63B 21/0615 482/104

(Continued)

OTHER PUBLICATIONS www.roguefitness.com/rogue-9-bar-holder.php (Jan. 29, 2014).*
www.maxwod.com/collections/storage/Bar-Storage (Sep. 24, 2013).*

*Primary Examiner* — Loan H Thanh
*Assistant Examiner* — Nyca T Nguyen
(74) *Attorney, Agent, or Firm* — Global Intellectual Property Agency, LLC; Daniel Boudwin

(57) ABSTRACT

A weighted stand for use in storing several barbells in an upright and vertical orientation. The device provides a first plate and a second plate placed in opposition to one another, creating an open space therebetween. Both the first plate and the second plate have a plurality of apertures in which tubular members extend therethrough and are connected thereto. The tubular members provide a hollow interior and a first open end and a second open end. The user can insert the bar portion of a barbell within the first open end of the tubular members for storage in a vertical orientation therein. A weight member is positioned within the open area between the first plate and the second plate for anchoring and stabilizing the device. Further, a mat portion is connected to the second side of the second plate in order to prevent said device from sliding on the floor.

8 Claims, 2 Drawing Sheets

(56) References Cited

U.S. PATENT DOCUMENTS

| | | | | |
|---|---|---|---|---|
| 6,123,651 | A | 9/2000 | Ellenburg | |
| 7,022,053 | B2 | 4/2006 | Whetstone | |
| 7,182,176 | B2 * | 2/2007 | Gibson | A47C 12/00 182/129 |
| 8,075,460 | B2 | 12/2011 | Parrilla | |
| 8,783,748 | B1 * | 7/2014 | Quinn | A01K 97/08 211/70.8 |
| 9,137,981 | B1 * | 9/2015 | Groves, Jr. | A47B 81/005 |

* cited by examiner

WEIGHTED BARBELL STAND

CROSS REFERENCE TO RELATED APPLICATION

This application claims the benefit of U.S. Provisional Application No. 62/000,867 filed on May 20, 2014. The above identified patent application is herein incorporated by reference in its entirety to provide continuity of disclosure.

BACKGROUND OF THE INVENTION

Field of the Invention

The present invention relates to barbell holding devices. More specifically, the present invention provides a weighted barbell stand comprising a pair of plates having a plurality of apertures, wherein vertical tubes extend between the pair of plates that can be utilized to hold and store a plurality of barbells in a vertical orientation.

Barbells are a common piece of gym exercise equipment. This equipment however, is quite heavy and difficult to maneuver. It can be a very serious hazard to others when barbells and weights are not properly stored and are left strewn about the floor in a gym, home or the like. People may become seriously and/or permanently injured by tripping over these barbells or by having a barbell or weight fall onto a portion of their body. Further, a device is needed that enables user to maintain a barbell in an upright position to decrease storage space and provide a safe area for a barbell to remain out of the reach of pets, children and the like.

Devices have been disclosed in the prior art that relate to storage apparatuses. These include devices that have been patented and published in patent application publications. These devices generally relate to stand apparatuses. Some devices provide barbell storage and exercise racks having a pair of cradles in which a barbell is laterally received and supported in a stored position, wherein the cradles are vertically adjustable in order to enable the user to easily remove and replace the barbell while maintaining a standing position. Other devices provide holders for barbells. These prior art devices have several known drawbacks and are not adapted to safely store barbells in an upright position. The present invention however, utilizes a pair of opposing plates having an integral weight member and a plurality of tubular members in which the bar of a barbell can remain therein.

In light of the devices disclosed in the prior art, it is submitted that the present invention substantially diverges in design elements from the prior art and consequently it is clear that there is a need in the art for an improvement to existing stand devices. In this regard the instant invention substantially fulfills these needs.

SUMMARY OF THE INVENTION

In view of the foregoing disadvantages inherent in the known types of barbell stand devices now present in the prior art, the present invention provides a new barbell stand device wherein the same can be utilized for providing convenience for the user when storing barbells in an upright position.

It is therefore an object of the present invention to provide a new and improved barbell stand device that has all of the advantages of the prior art and none of the disadvantages.

It is another object of the present invention to provide a barbell stand device comprising a pair of plates arranged in a stacked orientation and separated by a space, wherein each plate includes a plurality of apertures, and wherein a plurality of tubes are arranged in a vertical orientation and extend between said pair of plates and that are used to store barbells in a vertical orientation.

Another object of the present invention is to provide a barbell stand device comprising a mat portion disposed on a plate thereof, wherein the mat is adapted to prevent the device from sliding on the ground.

Another object of the present invention is to provide a barbell stand device that includes a plurality of hollow tubular members in which the handle of a barbell can be inserted and held therein.

Yet another object of the present invention is to provide a barbell stand device comprising a weighted member disposed between the pair of plates that serves to anchor and stabilize the barbell stand device to prevent the same from tipping over.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
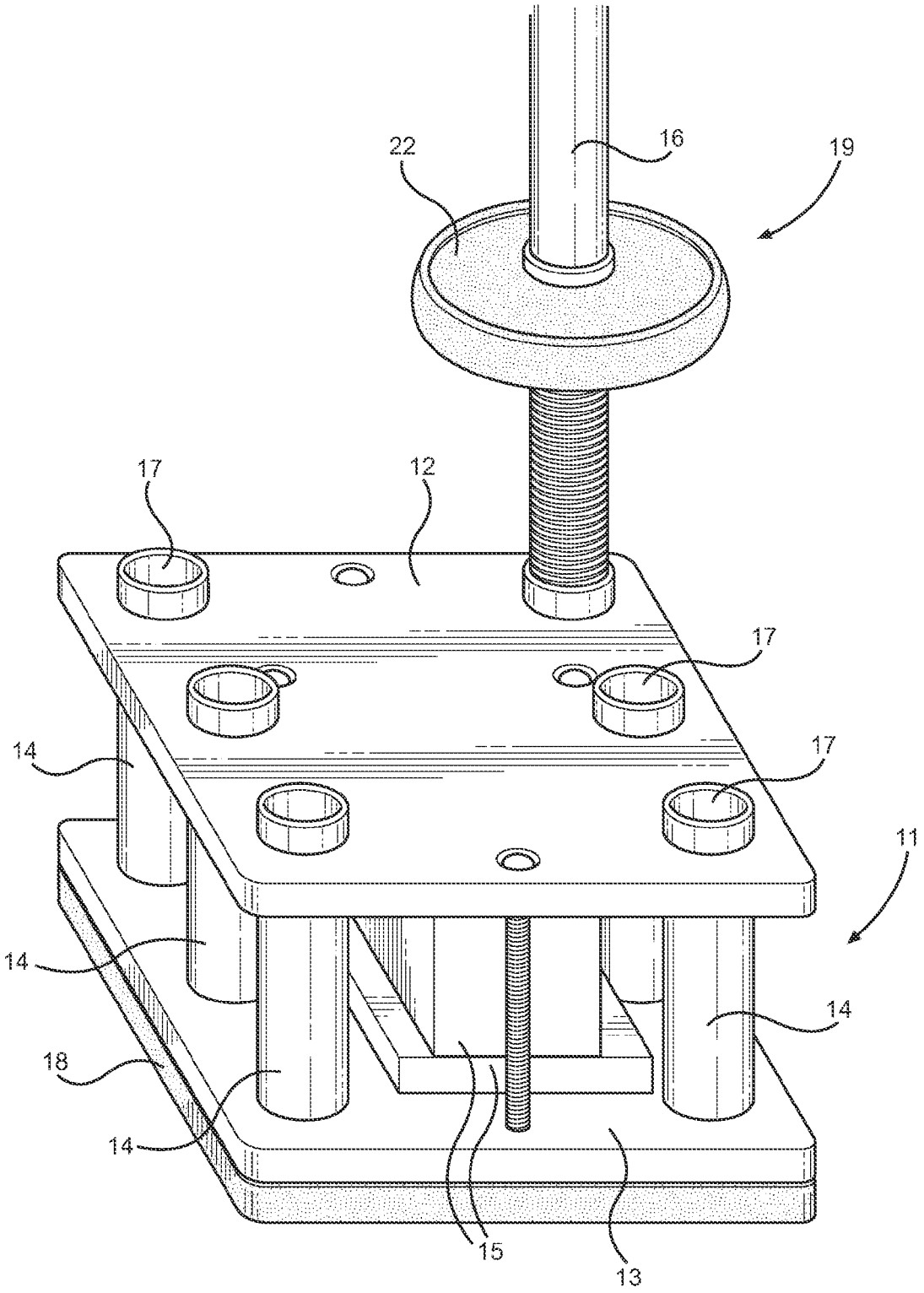
FIG. 1 shows a front overhead view of the weighted stand having a pair of plates and tubular members.

Reference is made herein to the attached drawings. Like reference numerals are used throughout the drawings to depict like or similar elements of the barbell storage apparatus. For the purposes of presenting a brief and clear description of the present invention, the preferred embodiment will be discussed as used for safely securing and storing barbells in an upright and vertical position when not in use. The figures are intended for representative purposes only and should not be considered to be limiting in any respect.

Referring now to FIG. 1, there is shown a front perspective view of the weighted stand 11. The weighted stand 11 provides a pair of plates being a first plate 12 and a second plate 13. Both the first plate 12 and the second plate 13 are substantially rectangular in shape in a preferred embodiment and provide a first side and a second side. The first plate 12 and the second plate 13 are arranged in a stacked orientation and disposed in a horizontal orientation. The plates 12, 13 are separated by a space such that the first plate 12 and the second plate 13 are parallel to one another.

The first plate 12 and the second plate 13 each comprise a plurality of apertures. The apertures preferably have a circular shape so as to receive a portion of a barbell 19 having a cylindrical shaft 16 therethrough. The apertures are preferably spaced at a fixed interval from one another, and preferably the apertures are arranged about the periphery of the plates 12, 13. The apertures on the first plate 12 are vertically aligned with the apertures on the second plate 13.

A plurality of tubular members 14 extend between the apertures on the first plate 12 and the apertures on the second plate 13. The tubular members 14 are preferably cylindrical and have a hollow interior volume. The tubular members 14 provide a first open end 17 and a second open end. Preferably, the first open end 17 of the tubular members 14 is not flush with the first side of the first plate 12, and extends slightly above the first side of the first plate 12. The second open end of the tubular members 14 is positioned as such that the second open end of the tubular members 14 contact and lay flush against the first side of second plate 13 and are connected thereto forming one unitary body. The interior of the tubular members 14 comprises a material that provides friction between the bar 16 of the barbell 19 placed therein and the interior surface of the tubular member 14, such that the bar 16 will not slip or slide or become scratched when placed within the hollow interior of the respective tubular members 14. Thus, the shaft 16 of a barbell 19 can be inserted into a tubular member 14 in a vertical orientation for storage, and one or more weights 22 can be positioned thereon.

The tubular members 14 and the first plate 12 and second plate 13 can be connected to one another via fasteners such as carriage bolts, screws, nails, clips, clasps and/or other suitable fasteners. The second plate 13 and the mat portion can be connected to one another via fasteners such as adhesives, bolts, screws, nails and/or other suitable materials. The first plate 12, the second plate 13 and the mat portion provides a substantial thickness.

The second plate 13 further includes a mat portion 18 disposed on the second side thereof. The mat portion 18 comprises a rectangular shape in a preferred embodiment and is substantially planar in structure. The mat portion 18 lays flush against and contacts the second side of the second plate 13. The mat portion 18 prevents the weighted stand 11 from sliding or becoming dislodged from the ground or surface upon which it is placed. The mat portion 18 can be made from various materials, including, but not limited to rubber, plastic, felt, cotton, stainless steel, neoprene and/or other suitable materials. The first plate 12 and the second plate 13 can be constructed from various materials, including, but not limited to stainless steel, weights, wood, rubber, metal, plastic, foam, rubber, iron, brass and/or other suitable materials.

The weighted stand 11 provides a weight member 15 that is integral with the first plate 12 and the second plate 13. The weight member 15 rests flush against the first side of the second plate 13 and extends upward toward the second side of the first plate 12. The weight member 15 contacts and lays flush thereagainst and can be connected to the first side of the second plate 13 and connected to the second side of the first plate 12. The weight member 15 is of sufficient weight to prevent the weighted stand 11 from tipping over when barbells are held therein. For example, the weighted member may be fifty pounds in a preferred embodiment, however the weight member 15 can be one hundred pounds or other suitable weight. In the illustrated embodiment, the weight member 15 comprises a rectangular structure, however in alternate embodiments the weight member 15 can have any of various other configurations.

Figure 2:
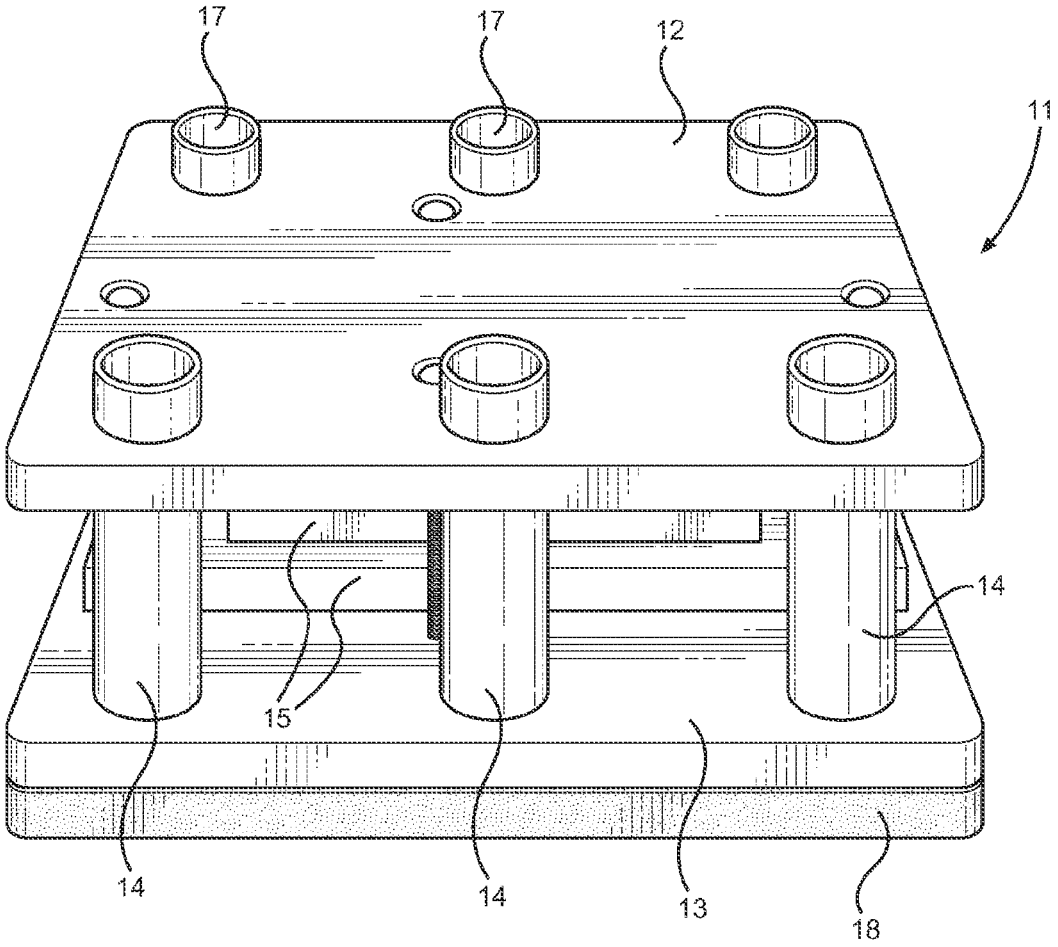
FIG. 2 shows a side perspective view of the weighted stand.

Referring now to FIG. 2, there is shown an overhead perspective view of the weighted stand. The first plate 12 and the second plate 13 are positioned as such that there is a substantially open space located therebetween. The tubular members 14 are situated in a vertical position and in a preferred embodiment. The weighted stand 11 is adapted to be utilized with a standard barbell having a bar portion and weighted plates that can be placed thereon. The bar portion of the standard barbell comprises an elongated shaft having a cylindrical structure with a first end and a second end being adapted to fit within the hollow interior of the tubular members 14.

The user can grasp the bar portion of the barbell and manually align the first end or the second end into the first open end 17 of the tubular member 14 and insert the end of the bar portion into the hollow interior of the tubular member 14 such that the first end or second end of the barbell that was placed into the first open end of the tubular member 14 contacts the first side of the second plate 13 of the weighted stand and remains flush thereagainst. Thus, the barbell will be stored and will remain within the hollow interior of the respective tubular member 14 in which it is placed. The weighted stand 11 is adapted to be used with a variety of barbells of various sizes and can hold a plurality of barbells at one time for convenience to the user. The weighted stand 11 thus enables user to safely and efficiently hold a barbell in an upright and vertical position to keep the barbell off of the floor for safety and storage purposes.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A weighted stand for holding barbells, comprising:

a first plate having a plurality of apertures and a second plate having a plurality of apertures;

a rectangular weight member connecting the first plate and the second plate such that the first plate and the second plate are in parallel orientation relative to one another;

wherein the rectangular weight member is configured to anchor and stabilize the weighted stand from tipping over;

wherein the plurality of apertures on the first plate and the plurality of apertures on the second plate are aligned with another and disposed along a peripheral edge of the first plate and the second plate;

a plurality of tubular members extending between the plurality of apertures on the first plate and the plurality of apertures between the second plate, the plurality of tubular members each having an open end and a hollow interior sized to receive a shaft of a barbell, the open end protruding from the first plate;

wherein the plurality of tubular members extend perpendicularly relative to the first plate and the second plate;

a mat portion disposed on a bottom side of the second plate, the mat portion having a material configured to prevent the weighted stand from sliding when positioned on a surface.

2. The weighted stand of claim 1, wherein the mat portion comprises a planar member having a rectangular shape.

3. The weighted stand of claim 2, wherein the mat portion matches a shape and size of the second plate.

4. The weighted stand of claim 1, wherein said plurality of apertures on said first plate and said plurality of apertures on said second plate are spaced at a fixed interval.

5. The weighted stand of claim 1, wherein the plurality of tubular members comprise a cylindrical shape and a cylindrical hollow interior sized to receive the shaft of the barbell therein, wherein the shaft is cylindrical.

6. The weighted stand of claim 1, wherein the first plate and second plate are removably attachable to one another via a fastener.

7. The weighted stand of claim 1, wherein the first plate and second plate are each planar members having a rectangular shape.

8. The weighted stand of claim 1, wherein the rectangular weight member comprises a weight ranging from 50-100 pounds.

* * * * *